US005832677A

United States Patent [19]

Kurttila

[11] Patent Number: 5,832,677

[45] Date of Patent: Nov. 10, 1998

[54] EVE AIR VENT

[76] Inventor: John O. Kurttila, 220 Ramona Ave., Pacifica, Calif. 94044

[21] Appl. No.: 963,419

[22] Filed: Nov. 3, 1997

[51] Int. Cl.[6] ..... E04B 7/00

[52] U.S. Cl. ..... 52/95; 52/302.1; 454/260

[58] Field of Search ..... 52/95, 302.1; 454/260

[56] References Cited

U.S. PATENT DOCUMENTS

| | | | |
|---|---|---|---|
| 3,972,164 | 8/1976 | Grange | 52/95 |
| 4,102,092 | 7/1978 | Ward | 52/92 |
| 4,214,510 | 7/1980 | Ward | 98/37 |
| 4,406,095 | 9/1983 | Slavik | 52/95 |
| 4,967,521 | 11/1990 | Pike | 52/95 |
| 4,997,714 | 3/1991 | Gregory, Jr. | 454/260 X |
| 5,361,551 | 11/1994 | Post | 52/95 |
| 5,433,050 | 7/1995 | Wilson et al. | 52/302.1 |
| 5,596,847 | 1/1997 | Stephenson | 52/198 |

OTHER PUBLICATIONS

North American Building Products, Inc. data sheet for HighPoint Vent—Series 3.1 sheet.

Ventec Ultimate Roof Edge installation instructions. 1 sheet.

Cor–A–Vent, Inc. S–400 Strip Vent with stucco and open rafter soffit. Architect reference drawing. 1 sheet. 1995.

Cor–A–Vent, Inc. S–400 Strip Vent with overhang and zero overhang soffit. Architect reference drawing. 1 sheet. 1995.

Cor–A–Vent, Inc. V–400T with zero overhang application. Architect reference drawing. 1 sheet. 1995.

*Primary Examiner*—Creighton Smith

*Attorney, Agent, or Firm*—Jack Lo

[57] ABSTRACT

An eve air vent includes upper and lower panels joined at their upper edges, and spaced apart at their lower edges to form a wedge shape. Longitudinal ribs are sandwiched between the upper and lower panels to form inlets at the lower edge, and air passages between the panels. Large outlet holes are provided on the lower panel. The vent is installed between the shingles and plywood sheathing of a roof, with its lower edge flush with the eve. A strip of plywood sheathing is removed, or left out during roof construction, to create a hole aligned with the outlets on the bottom of the vent. Air is thus able to enter from the outside environment through the inlets at the lower edge of the vent, and pass through the holes in the plywood sheathing into the attic. The vent is installed without modification to the eve, and it does not protrude beyond the eve, so that it does not mar the appearance of the eve.

6 Claims, 2 Drawing Sheets

EVE AIR VENT

BACKGROUND OF THE INVENTION

1. Field of the Invention

This invention relates generally to air vents installed at the eve of a roof for ventilating an attic.

2. Prior Art

Building codes require that a roof for a house must be built to breath, i.e., air must be allowed to pass between the attic and the outside environment. A wood shingled roof normally allows breathing between the shingles. During reroofing, when the shingles are typically replaced with asphalt, plywood sheathing must be installed as a substrate. The plywood sheathing is a solid barrier, so that vents must be installed to provide ventilation. Typically, ridge vents are installed at the top of the roof, and eve vents are installed at the eve or lower edge of the roof. Available eve vents either require expensive modifications to the eve, or they protrude outside and mar the cosmetic appearance of the eve, which is particularly undesirable for roofs with zero overhang. Vents that protrude outside also partially cover the opening of the gutter.

U.S. Pat. Nos. 5,596,847 to Stephenson; 4,406,095 to Slavik, 4,446,661 to Jonsson et al.; 4,214,510 to Ward; 4,102,092 to Ward; and 3,972,164 to Grange show corrugated baffles for installing between a roof and an attic floor for allowing breathing around insulation. They do not by themselves provide an air passage between the attic and the outside environment, so that they must be combined with eve vents or modifications to the eve. U.S. Pat. No. 5,361,551 to Post shows an eve vent which requires cutting of the eve and roof sheathing. It also protrudes outside the eve, so that it is unsightly. Eve vents sold by Cor-A-Vent, Inc. and Ventec can be installed in roofs with zero overhang, but they all require eve and roof modifications. Further, they provide an air inlet at the eve line, which is at the same level as the insulation in the attic, so that they must be used in combination with insulation baffles that provide an air passage through the insulation. U.S. Pat. No. 4,967,521 to Pike shows a riser that slightly lifts the shingles for draining water. It does not provide venting.

OBJECTS OF THE INVENTION

Accordingly, objects of the present invention are:

to provide attic ventilation at the eve line;

to provide ventilation without having to modify the eve, which is particularly desirable when there is zero overhang;

to provide ventilation without marring the appearance of the eve;

to provide ventilation without requiring insulation baffles; and to enable easy and inexpensive installation.

Further objects of the present invention will become apparent from a consideration of the drawings and ensuing description.

BRIEF SUMMARY OF THE INVENTION

An eve air vent includes top and bottom panels joined at their upper edges, and spaced apart at their lower edges to form a wedge shape. Longitudinal ribs are sandwiched between the top and bottom panels to form inlets at the lower edge, and air passages between the panels. Large outlet holes are provided on the bottom panel. The vent is installed between the shingles and plywood sheathing of a roof, with its lower edge flush with the eve. A strip of plywood sheathing is removed, or left out during roof construction, to create a hole aligned with the outlets on the bottom of the vent. Air is thus able to enter from the outside environment through the inlets at the lower edge of the vent, and pass through the hole in the plywood sheathing into the attic. The vent is installed without modification to the eve, and it does not protrude beyond the eve, so that it does not mar the appearance of the eve.

Figure 1:
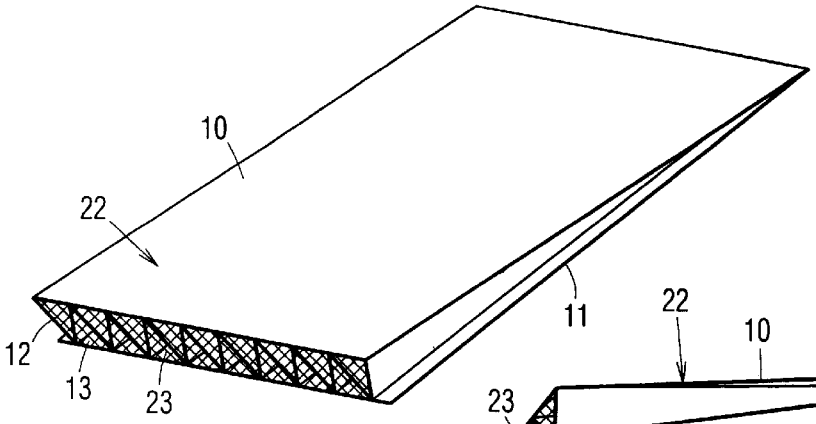
FIG. 1 a top perspective view of an eve air vent in accordance with the invention.

| DRAWING REFERENCE NUMERALS | |
|---|---|
| 10. Upper Panel | 11. Lower Panel |
| 12. Ribs | 13. Inlets |
| 14. Outlets | 15. Air Passages |
| 16. Plywood Sheathing | 17. Eve |
| 18. Shingles | 19. Hole |
| 20. Attic | 21. Insulation |
| 22. Wedge-Shaped Body | 23. Insect Screen |

DETAILED DESCRIPTION OF THE INVENTION

Figure 2:
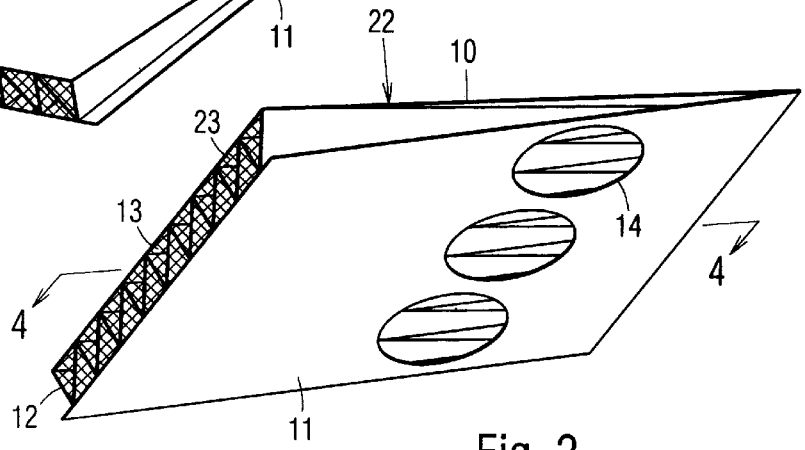
FIG. 2 is a bottom perspective view.
Figure 3:
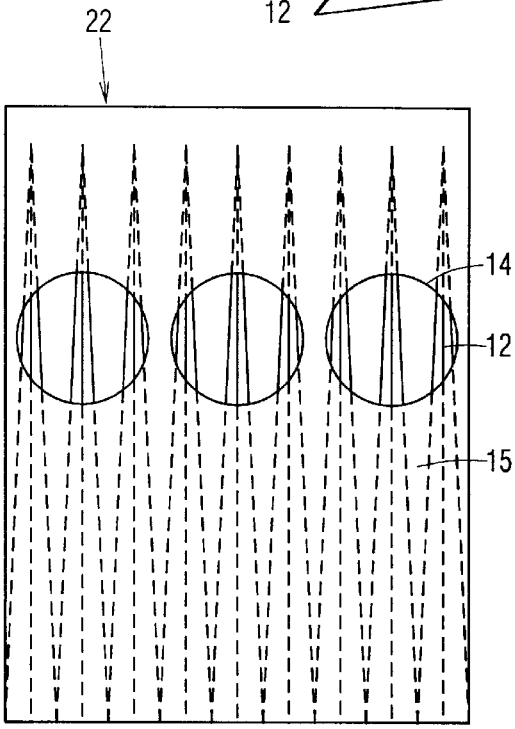
FIG. 3 is a bottom view.
Figure 4:
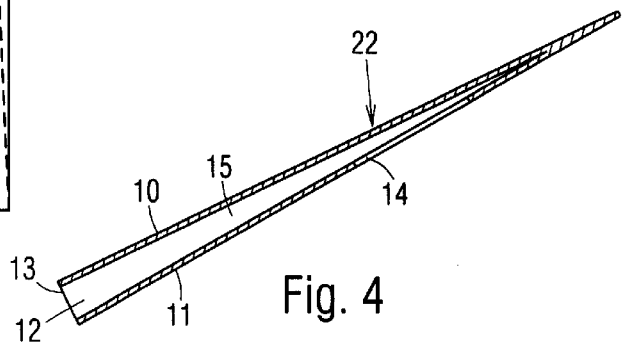
FIG. 4 is a side sectional view, taken along line 4—4 in FIG. 2.

A preferred embodiment of the eve air vent is shown in the top perspective view in FIG. 1, the bottom perspective view in FIG. 2, the bottom view in FIG. 3, and the sectional view in FIG. 4. It includes an upper panel 10 and a bottom panel 11 joined along their upper edges and spaced apart at their lower edges to form a wedge-shaped body 22 with a thin upper edge and a thicker lower edge. Longitudinal ribs 12 sandwiched between upper panel 10 and lower panel 11 define air inlets 13 at the lower edge. Outlet holes 14 are arranged on lower panel 11. Inlets 13 and outlets 14 are connected by air passages 15 between upper panel 10 and lower panel 11. An insect screen 23 is positioned across inlets 13. The vent is preferably made of plastic or sheet metal, although any other suitable material can be used.

Figure 5:
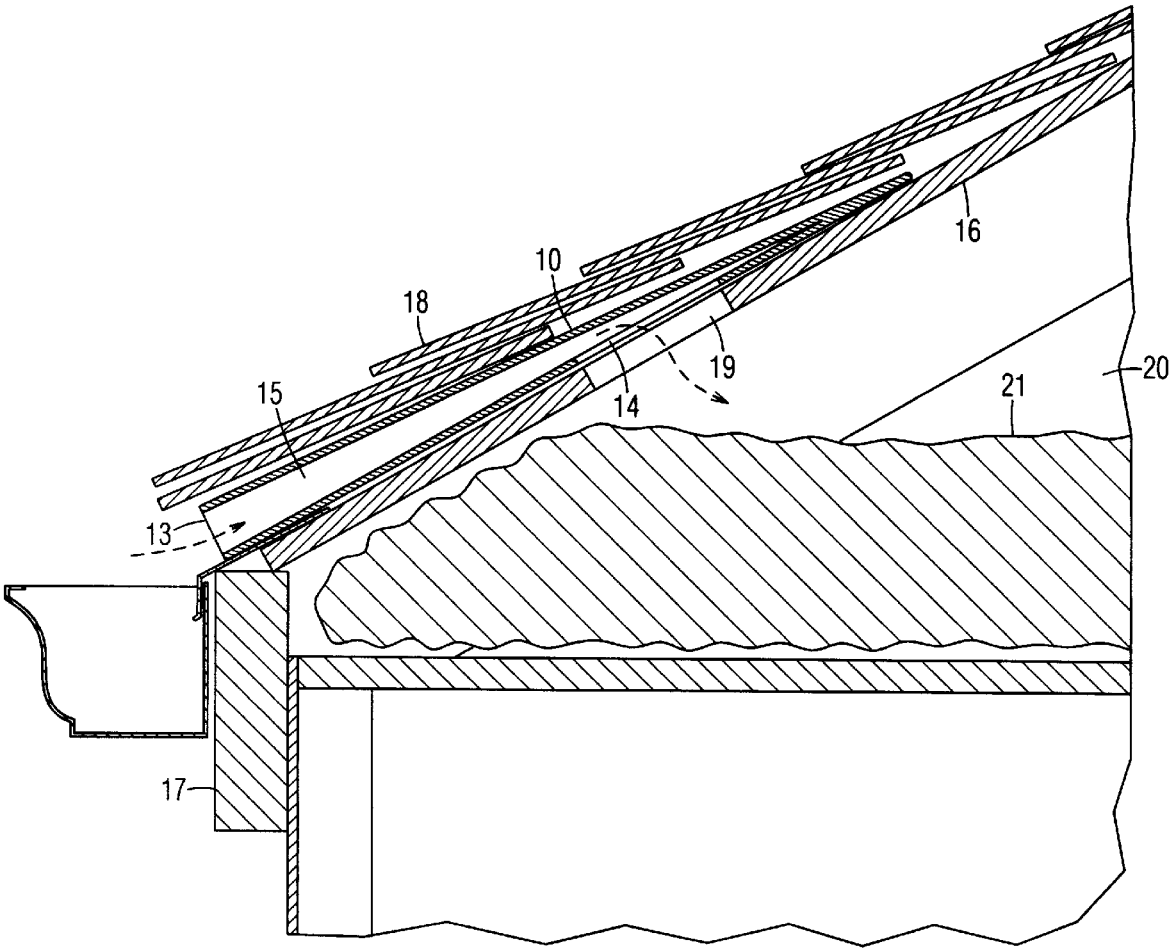
FIG. 5 is a side sectional view of the vent installed on a roof.

As shown in FIG. 5, the vent is nailed or otherwise secured on top of plywood sheathings 16 of a roof, which is just as easy as installing a shingle. The lower edge of the vent is positioned flush with an eve 17. Shingles 18 are installed on top of the vent. The wedge shape of the vent allows shingles 18 to be smoothly laid over it. Upper panel 10 provides a flat and smooth support for shingles 18. A strip of plywood sheathing is removed, or left out during roof construction, to create a hole 19 aligned with outlets 14 on the bottom of the vent. Removing or leaving out a strip of plywood sheathing to create a hole is much easier and thus less expensive than the eve modifications required by prior art vents. Air is thus able to enter inlets 13, pass through air passages 15, outlets 14, and hole 19 into an attic 20, and exit through a separate ridge vent (not shown) on top of the roof. Unlike prior art vents which provide outlets at the level of the insulation, outlets 14 and hole 19 are positioned above insulation 21, so that insulation baffles are rendered unnecessary to lower costs.

SUMMARY AND SCOPE

Accordingly, an eve air vent is provided for ventilating an attic. It provides ventilation without having to modify the eve. It provides ventilation without marring the appearance of the eve. It does not protrude into the gutter. It provides ventilation without requiring insulation baffles. It can be installed easily and inexpensively, either during re-roofing or new home construction.

Although the above descriptions are specific, they should not be considered as limitations on the scope of the invention, but only as examples of the embodiments. Many substitutes and variations are possible within the teachings of the invention. For example, lower panel 11 may be eliminated, so that air passages 15 are defined by upper panel 10, ribs 12, and plywood sheathing 16 of the roof, and outlets 14 comprise the entire lower surfaces of ribs 12. Instead of being a flat sheet, upper panel 10 may be formed by the top surfaces of ribs 12, so that it is corrugated. Instead of angled, ribs 12 may be of other shapes, such as vertical or wavy. More or fewer outlets 14 may be provided. The vent may be provided in any suitable size. Hole 19 may be made by cutting into a plywood sheathing instead of with an absent plywood sheathing. Insect screen 23 can be eliminated. Therefore, the scope of the invention should be determined by the appended claims and their legal equivalents, not by the examples given.

I claim:

1. An eve air vent, comprising:

a wedge-shaped body with a generally thin sharp upper edge and a thicker lower edge;

an air passage extending through wedge-shaped body from said lower edge toward said upper edge, said air passage forming an inlet at said lower edge; and an outlet arranged on a bottom surface of said wedge-shaped body, said outlet communicating with said inlet through said air passage, said wedge-shaped body for attaching on a roof between a sheathing and a shingle, said thin sharp upper edge for lifting said shingle smoothly from said sheathing, said lower edge and said inlet for aligning with an eve of said roof, said outlet for aligning with a hole in said sheathing communicating with an attic below said roof, said vent for enabling outside air to enter said attic through said inlet, said air passage, said outlet, and said hole in said sheathing.

2. The eve air vent of claim 1, further including an insect screen positioned across said inlet.

3. An eve air vent, comprising:

a wedge-shaped body with a generally thin sharp upper edge and a thicker lower edge, said wedge-shaped body comprising a top panel, and a plurality of longitudinal ribs attached to a bottom surface of said top panel and extending in a direction between said upper edge and said lower edge;

a plurality of air passages defined by said ribs, said air passages forming a plurality of inlets at said lower edge; and an outlet arranged on a bottom surface of said wedge-shaped body, said outlet communicating with said inlets through said air passages, said wedge-shaped body for attaching on a roof between a sheathing and a shingle, said thin sharp upper edge for lifting said shingle smoothly from said sheathing, said lower edge and said inlets for aligning with an eve of said roof, said outlet for aligning with a hole in said sheathing communicating with an attic below said roof, said vent for enabling outside air to enter said attic through said inlets, said air passages, said outlet, and said hole in said sheathing.

4. The eve air vent of claim 3, further including an insect screen positioned across said inlets.

5. An eve air vent, comprising:

an upper panel and a lower panel joined along corresponding upper edges and spaced apart at corresponding lower edges forming a wedge-shaped body;

a plurality of longitudinal ribs attached between said upper panel and said lower panel, and extending in a direction between said upper edge and said lower edge;

a plurality of air passages defined by said ribs, said air passages forming a plurality of inlets at said lower edge; and an outlet arranged on said bottom panel, said outlet communicating with said inlets through said air passages, said wedge-shaped body for attaching on a roof between a sheathing and a shingle, said lower edge and said inlets for aligning with an eve of said roof, said outlet for aligning with a hole in said sheathing communicating with an attic below said roof, said vent for enabling outside air to enter said attic through said inlets, said air passages, said outlet, and said hole in said sheathing.

6. The eve air vent of claim 5, further including an insect screen positioned across said inlets.

* * * * *